US007976128B2

(12) United States Patent
Sugahara

(10) Patent No.: US 7,976,128 B2
(45) Date of Patent: Jul. 12, 2011

(54) LIQUID TRANSPORTING APPARATUS AND PRINTER

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 739 days.

(21) Appl. No.: 12/022,972

(22) Filed: Jan. 30, 2008

(65) Prior Publication Data

US 2008/0180488 A1 Jul. 31, 2008

(30) Foreign Application Priority Data

Jan. 30, 2007 (JP) ..... 2007-019293

(51) Int. Cl.
*B41J 2/04* (2006.01)

(52) U.S. Cl. ..... 347/54; 347/55; 347/58; 347/59

(58) Field of Classification Search ..... 347/58, 347/59, 65, 54, 55, 9, 17
See application file for complete search history.

(56) References Cited

U.S. PATENT DOCUMENTS

| | | | | |
|---|---|---|---|---|
| 6,154,226 | A * | 11/2000 | York et al. | 346/140.1 |
| 2005/0219330 | A1* | 10/2005 | Sugahara | 347/75 |
| 2005/0258719 | A1* | 11/2005 | Sugahara et al. | 310/365 |

FOREIGN PATENT DOCUMENTS

| | | | |
|---|---|---|---|
| CN | 1721182 | A | 1/2006 |
| EP | 1612046 | A1 | 1/2006 |
| EP | 1738911 | A3 | 2/2008 |
| JP | 2005199231 | A | 7/2005 |
| JP | 2005-288875 | A | 10/2005 |
| JP | 2005288875 | A | 10/2005 |
| WO | 9426522 | A1 | 11/1994 |

OTHER PUBLICATIONS

The State Intellectual Property Office of the People's Republic of China; Notification of First Office Action in CN Application No. 200810004461.0 (counterpart to the above-captioned U.S. patent application) mailed Oct. 16, 2009.

European Patent Office; European Search Report in European Patent Application No. 08001537.3 (counterpart to the above-captioned U.S. patent application) mailed Nov. 4, 2009.

* cited by examiner

*Primary Examiner* — Matthew Luu
*Assistant Examiner* — Henok Legesse
(74) *Attorney, Agent, or Firm* — Baker Botts L.L.P.

(57) ABSTRACT

There is provided a liquid transporting apparatus which includes a substrate having an insulating surface, a plurality of liquid transporting channels, a common liquid chamber which supplies a liquid to the liquid transporting channels, a plurality of individual electrodes arranged on the plurality of liquid transporting channels respectively, an insulating layer which covers the individual electrodes, a plurality of wire portions which are connected to the individual electrodes respectively, and a driver IC which applies a driving electric potential to the individual electrodes. Accordingly, it is possible to make simple a structure of the liquid transporting apparatus, and to reduce a manufacturing cost.

15 Claims, 14 Drawing Sheets

FRONT SIDE ←

LIQUID TRANSPORTING APPARATUS AND PRINTER

CROSS REFERENCE TO RELATED APPLICATION

The present application claims priority from Japanese Patent Application No. 2007-019293, filed on Jan. 30, 2007, the disclosure of which is incorporated herein by reference in its entirety.

BACKGROUND OF THE INVENTION

1. Field of the Invention

The present invention relates to a liquid transporting apparatus which transports a liquid and a printer.

2. Description of the Related Art

Generally, an ink-jet recording head which jets the ink from a nozzle to a recording medium such as a recording paper has been adopted in printers in which an image is recorded by discharging an ink on to the recording medium. However, in such ink-jet recording head, a channel structure and an actuator structure for generating a jetting pressure in the ink is peculiar and complicated, and therefore, there have been limitations on facilitating a size reduction of the recording head by arranging a plurality of nozzles highly densely.

Therefore, inventors of the present invention have proposed a new type of recording head in which a developing phenomenon (electrowetting phenomenon) is used, in which a liquid repellent property (wetting angle), on a surface of an insulating layer covering a surface of a certain electrode, changes when an electric potential applied to the electrode is changed (refer to Japanese Patent Application Laid-open No. 2005-288875 for example). This recording head includes a plurality of individual channels formed by a plurality of grooves. Moreover, an individual electrode is provided to each of the individual channels (bottom surface of the grooves), and further, the insulating layer covers a surface of the individual electrodes. Moreover, the ink inside the recording head is in contact with a common electrode, which is kept at a ground electric potential, and the ink is at the ground electric potential all the time. Furthermore, at an upstream side of the individual channels, a pump, which pressurizes the ink toward a discharge portion at a front end thereof, is provided.

Here, the electric potential of the individual electrode is a ground electric potential, and with no electric potential difference between the ink and the individual electrode, the liquid repellent property (wetting angle) on the surface of the insulating layer sandwiched between the ink and the individual electrode is higher as compared to a liquid repellent property of an area of the bottom surface of the groove, in which the insulating layer is not provided. Therefore, the ink cannot flow to the discharge portion crossing the surface of the insulating layer, and the ink is not discharged from the discharge portion. On the other hand, when the electric potential of the individual electrode is switched to a predetermined electric potential, an electric potential difference is developed between the ink and the individual electrode, and the liquid repellent property (wetting angle) on the surface of the insulating layer sandwiched between the ink and the individual electrode is declined (electrowetting phenomenon). As the liquid repellent property of the insulating layer is declined, the ink pressurized by the pump is capable of moving to the discharge portion, thereby wetting the surface of the insulating layer, and is discharged from the discharge portion. Moreover, since such recording head has a simple structure in which the individual electrode, the common electrode, and the insulating layer are formed on a surface of a substrate forming the individual channels, it is possible to reduce a size of the recording head.

SUMMARY OF THE INVENTION

Here, in the recording head described in Japanese Patent Application Laid-open No. 2005-288875, it is necessary to connect a driver IC, which applies the electric potential described above, to the individual electrode. Moreover, connecting the individual electrode and the driver IC via a wiring member such as a flexible printed cable (FPC) can be taken into consideration. However, when the individual electrode and the driver IC are connected by using the wiring member, a structure of electrical connections in the recording head becomes complicated, and a manufacturing cost becomes high.

An object of the present invention is to provide a liquid transporting apparatus having a simple structure of electrical connections, in addition to an ability to simplify a structure by using the electrowetting phenomenon described above, and having a low manufacturing cost.

According to a first aspect of the present invention, there is provided a liquid transporting apparatus which transports an electroconductive liquid, including a substrate having an insulating surface;

a plurality of liquid transporting channels which transport individually the electroconductive liquid and which are arranged at intervals on a plurality of first areas of the insulating surface, respectively, the first areas defining the liquid transporting channels and;

a common liquid chamber which communicates with the liquid transporting channels, and which supplies the electroconductive liquid to the liquid transporting channels;

a plurality of individual electrodes arranged on the first areas of the insulating surface respectively;

an insulating layer which covers the individual electrodes, and a liquid repellent property of a surface of the insulating layer changes depending on an electric potential difference between the electroconductive liquid and the individual electrode;

a plurality of wire portions which are arranged on the insulating surface, and which are connected to the individual electrodes respectively; and a driver IC which is arranged on the insulating layer and which is connected to the wire portions, and which applies a driving electric potential to the individual electrodes via the wire portions.

According to the liquid transporting apparatus of the present invention, since the driver IC is arranged on the insulating surface of the substrate, it is possible to connect directly the wire portions and the driver IC on the insulating surface. Accordingly, a wiring member such as an FPC is unnecessary, and it is possible to simplify a structure of electrical connections of the liquid transporting apparatus, and to reduce a manufacturing cost.

In the liquid transporting apparatus of the present invention, the individual electrodes, the wire portions, and the driver IC may be provided on the same plane. In this case, it is possible to connect easily the individual electrodes, the wire portions, and the driver IC.

In the liquid transporting apparatus of the present invention, the wire portions may be extended up to the driver IC upon passing through a second area which is positioned between the liquid transporting channels, on the insulating surface. In this case, since the wire portions pass through portions between the liquid transporting channels, an unnecessary electrostatic capacitance is not generated between the wire portions and the liquid in the liquid transporting channels.

In the liquid transporting apparatus of the present invention, the liquid transporting channels may be isolated by partition walls arranged between the liquid transporting channels, and a portion of the wire portions positioned on the second area may be covered by the partition walls. Accordingly, since the wire portions are covered by the partition walls separating the liquid transporting channels, it is possible to prevent the liquid from making a contact with the wire portions.

In the liquid transporting apparatus of the present invention, a portion of the wire portions positioned on the second area may be covered by the insulating layer. Accordingly, since the wire portions are covered by the insulating layer, it is possible to prevent assuredly the wire portions from making a contact with the liquid.

In the liquid transporting apparatus of the present invention, the wire portions may be extended up to the driver IC upon passing through the first area, and a portion of the wire portions passing over the first area may be covered by the insulating layer. Accordingly, since the wire portions are arranged in the liquid transporting channels, it is possible to improve a degree of integration by sandwiching between the liquid transporting channels.

In the liquid transporting apparatus of the present invention, the liquid transporting channels and the common liquid chamber may be provided on the same plane. Accordingly, a structure of the liquid channels from the common liquid chamber reaching up to the liquid transporting channels becomes simple.

In the liquid transporting apparatus of the present invention, the driver IC may be arranged near the common liquid chamber. When the liquid transporting apparatus is to be made small, it is necessary to arrange the driver IC near the liquid transporting channels or the common liquid chamber. On the other hand, a viscosity of the liquid inside the liquid transporting channels and the common liquid chamber changes due to a heat generated in the driver IC. Here, when the driver IC is arranged near the liquid transporting channels, since a separating (isolating) distance between each of the plurality of the liquid transporting channels, and the driver IC differs mutually, a change in the viscosity of the liquid in the liquid transporting channels vary mutually depending on the separating distance from the driver IC. Accordingly, there is a variation in transporting characteristics of the liquid, among the liquid transporting channels.

Whereas, when the driver IC is arranged near the common liquid chamber, since the heat generated in the driver IC after being transmitted to the liquid inside the common liquid chamber, diffuses through the liquid inside the common liquid chamber to the liquid in each liquid transporting channel, the change in the viscosity of the liquid among the liquid transporting channels becomes uniform. Consequently, it is possible to prevent the variation in the transporting characteristics of the liquid, among the liquid transporting channels.

In the liquid transporting apparatus of the present invention, a liquid supply port which supplies the electroconductive liquid may be formed in the common liquid chamber, and the driver IC may be arranged near the liquid supply port. In this case, when the driver IC is arranged near the liquid supply port, since the driver IC is positioned at an upstream portion of the common liquid chamber, the heat generated in the driver IC diffuses assuredly through the liquid inside the common liquid chamber to the liquid inside each liquid transporting channel, it is possible to prevent assuredly the variation in the viscosity of the liquids in the liquid transporting channels.

In the liquid transporting apparatus of the present invention, the insulating surface may have a third area defining the common liquid chamber, the wire portions may pass through the third area of the insulating surface, and a portion of the wire portions passing through the third area may be covered by the insulating layer. In this case, it is possible to arrange the wire portions inside the common liquid chamber while insulating from the liquid by covering the wire portions by the insulating layer inside the common liquid chamber, and a degree of freedom of arranging the wire portions becomes high.

In the liquid transporting apparatus of the present invention, a common electrode which is kept at a constant electric potential may be arranged in the third area, and the wire portions may intersect with the common electrode via the insulating layer in the third area. In this case, inside the common liquid chamber, it is not necessary to arrange the wire portions to avoid the common electrode, and the degree of freedom of arranging the wire portions becomes high.

In the liquid transporting apparatus of the present invention, the common electrode and the wire portions may make a thermoconductive contact with the driver IC, and may make a thermoconductive contact with the electroconductive liquid. In this case, it is possible to transmit efficiently the heat generated in the driver IC to the liquid, and to release the heat in the liquid.

In the liquid transporting apparatus of the present invention, the common electrode may make a direct contact with the liquid. In this case, since the common electrode makes a direct contact with the liquid, it is possible to release the heat efficiently from the common electrode in the liquid, and to prevent overheating of the driver IC.

In the liquid transporting apparatus of the present invention, the substrate may be made of silicon or polyimide, and the insulating layer may be made of a fluororesin. In this case, since the substrate is made of silicon or polyimide, it is possible to secure non-electroconductivity and strength of the substrate. Moreover, since the insulating layer is formed of a fluororesin, it is possible to form easily the insulating layer having a superior liquid repellent property by a method such as a spin coating method and a chemical vapor deposition (CVD) method.

According to a second aspect of the present invention, there is provided a printer in which the electroconductive liquid is an ink, including a liquid transporting apparatus according to the present invention, an ink tank which stores the ink, and a tube which connects the liquid transporting apparatus and the ink tank. In this case, as an ink, it is possible to use an aqueous dye ink in which a dye and a solvent are added to water, and an aqueous pigment ink in which pigments and a solvent are added to water. Moreover, since the liquid transporting apparatus of the present invention may not include a movable component such as an actuator, a jetting mechanism having a complicated structure is not necessary for jetting the ink, and it is possible to suppress the power consumption.

DETAILED DESCRIPTION OF THE PREFERRED EMBODIMENTS

Exemplary embodiments of the present invention will be described below.

Figure 1:
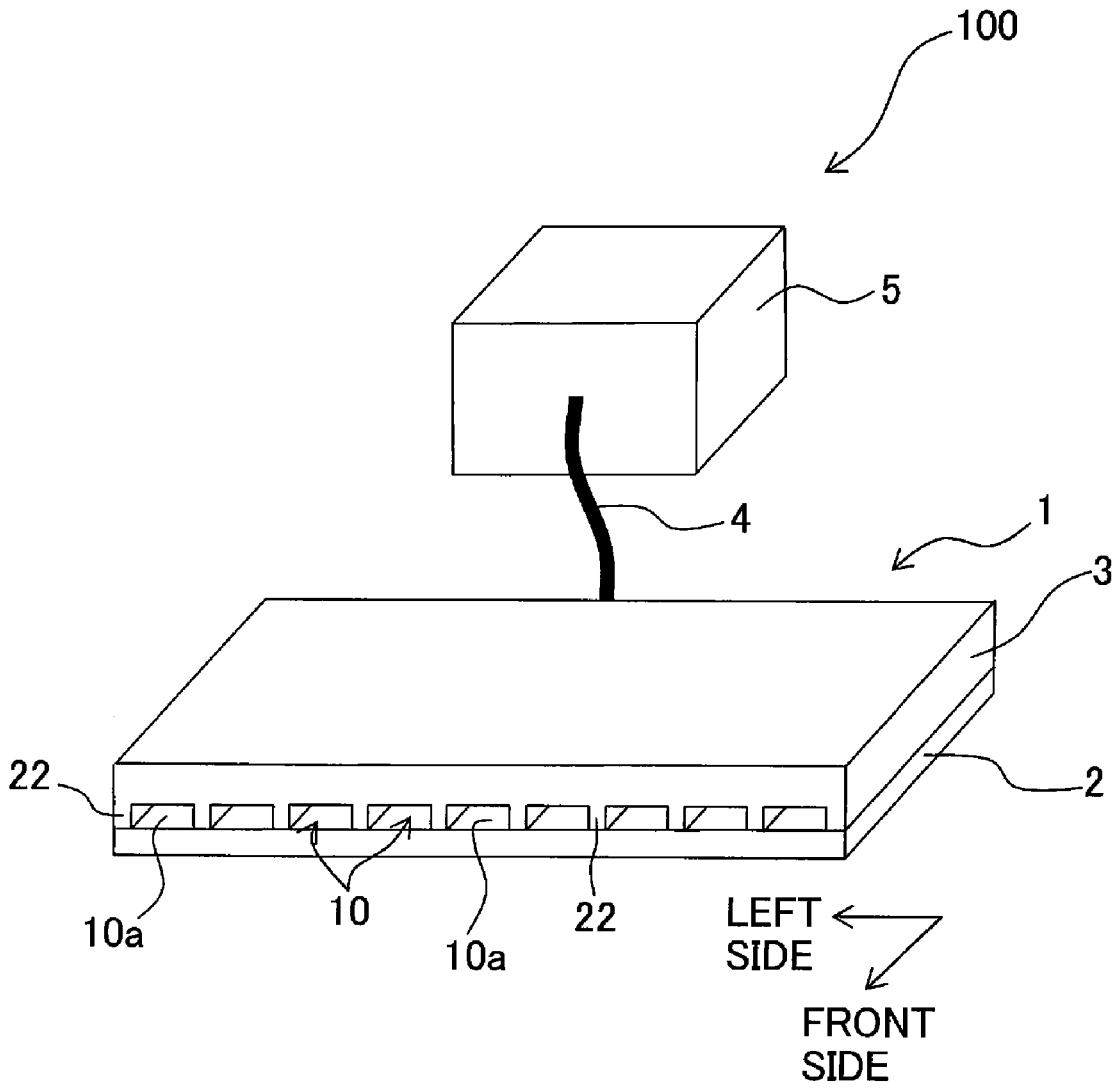
FIG. 1 is a schematic structural view of a printer according to an embodiment of the present invention.

FIG. 1 is a schematic view of a printer including a liquid transporting apparatus according to an embodiment. As shown in FIG. 1, a printer 100 includes an ink transporting head 1 (liquid transporting apparatus) which includes a plurality of individual ink channels 10 (liquid transporting channels) provided with a discharge port 10*a*, and an ink tank 5 which is connected to the ink transporting head 1 via a tube 4. Moreover, the printer 100 records a desired image on a recording paper P by jetting an ink from the plurality of jetting ports 10*a* of the ink transporting head 1, toward a recording paper P (refer to FIG. 5). The ink to be used in the printer is an electroconductive ink such as an aqueous dye ink in which a dye and a solvent are added to water which is a main component, and an aqueous pigment ink in which pigments and a solvent are added to water which is a main component. Moreover, hereinafter, front and rear directions, and left and right directions in FIG. 1 is defined as front and rear directions and left and right directions, respectively, in the following description.

Figure 2:
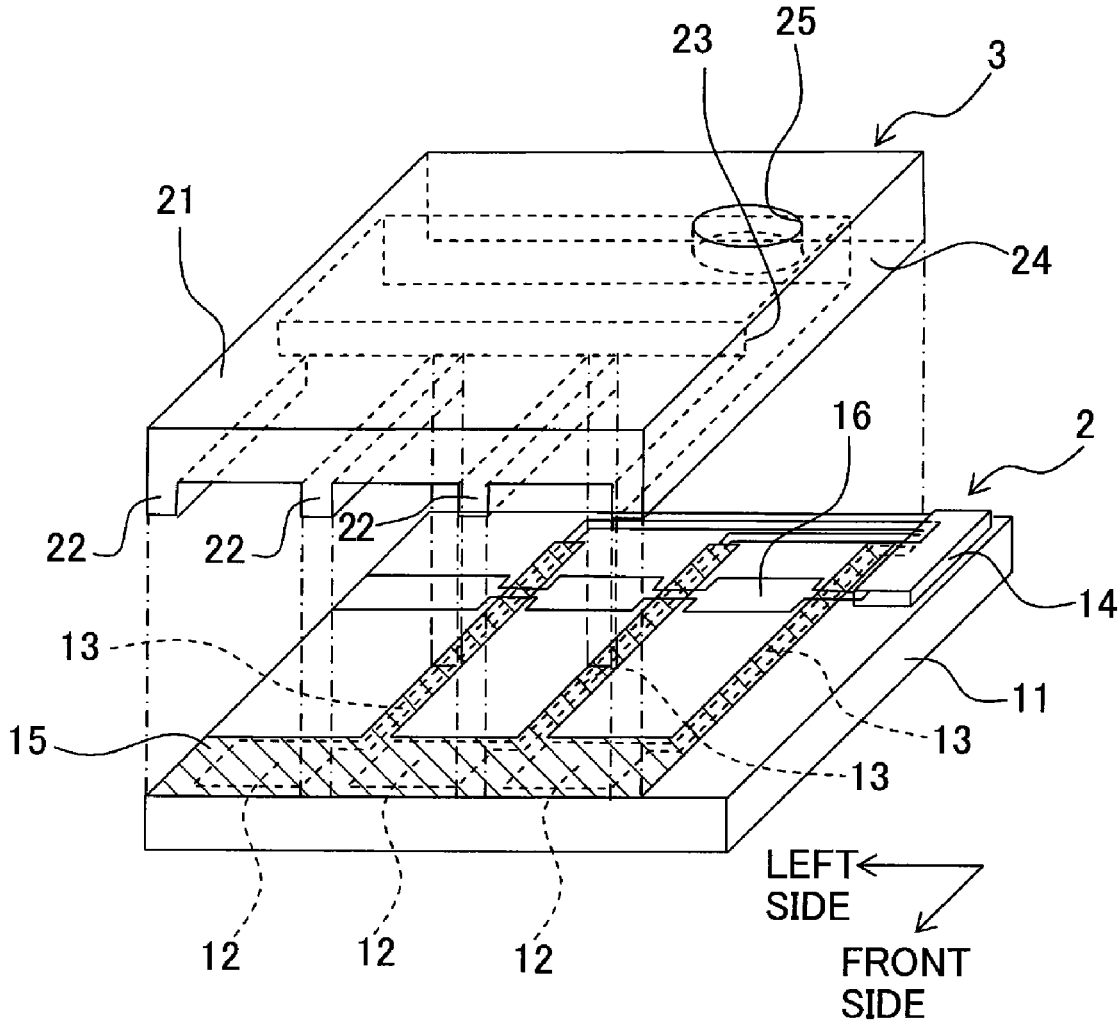
FIG. 2 is an exploded perspective view in which a part (portion) of an ink transporting head in FIG. 1 is enlarged.
Figure 3:
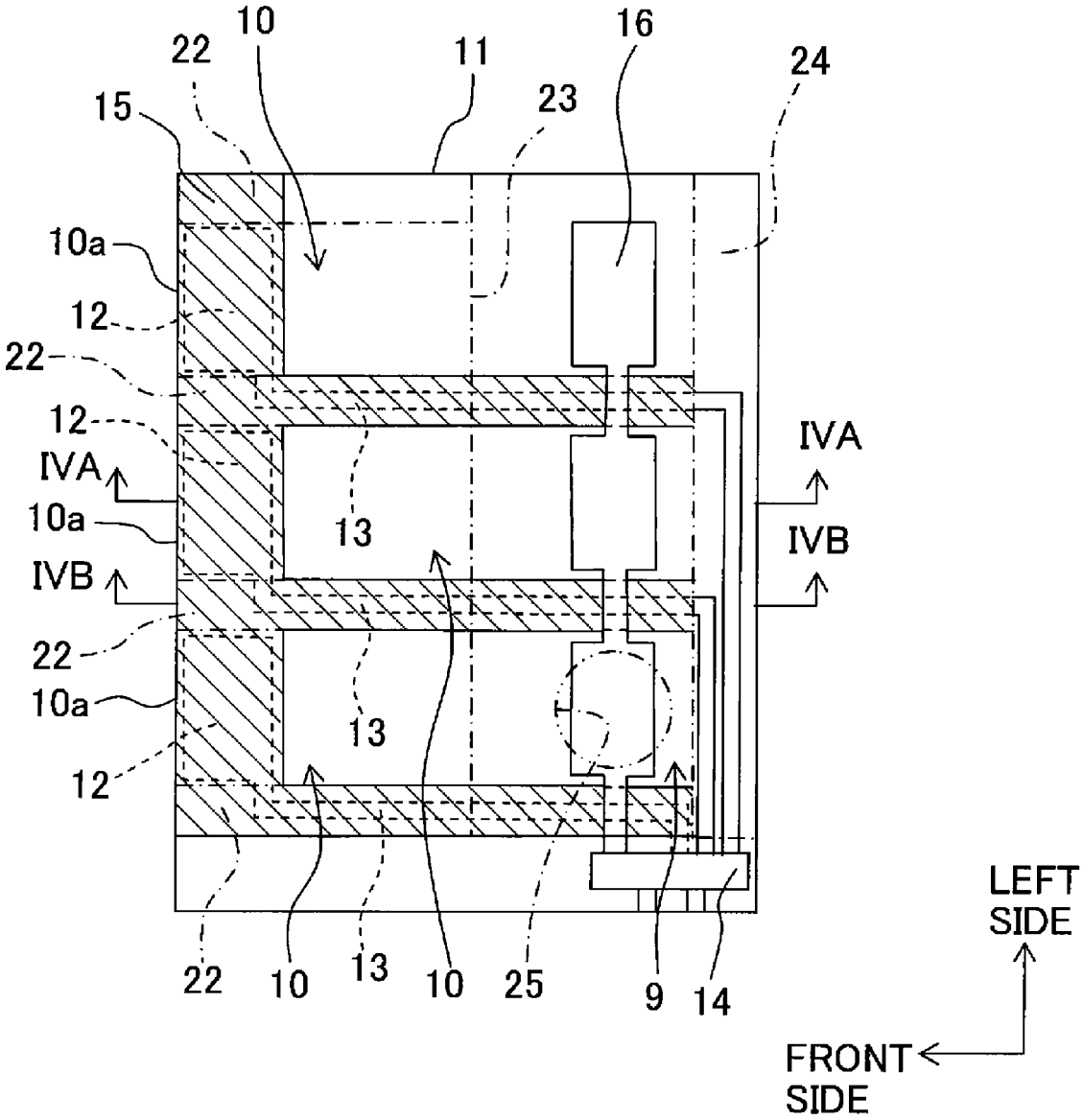
FIG. 3 is a plan view of the recording head in FIG. 2.
Figure 4A:
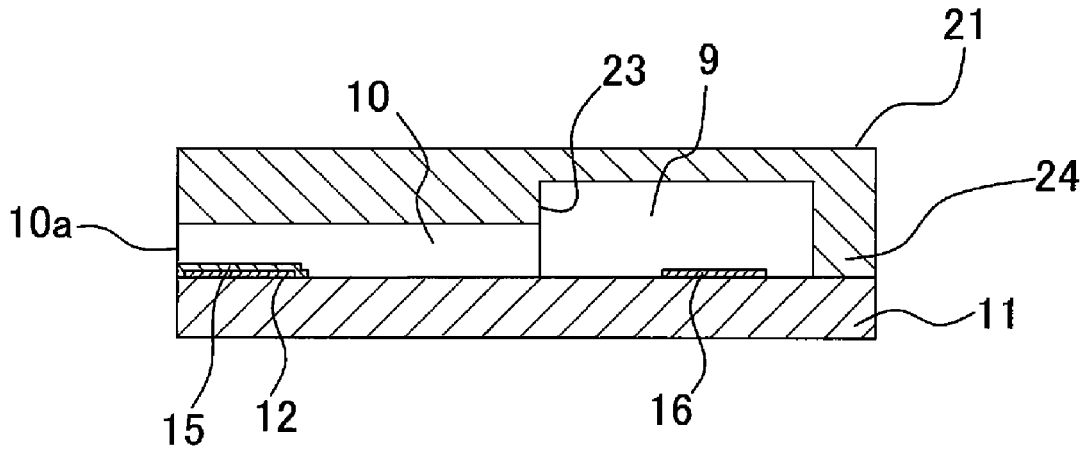
FIGS. 4A and 4B are cross-sectional views taken along a line IVA-IVA and a line in FIG. 3 and taken along a line IVB-IVB in FIG. 3, respectively.
Figure 4B:
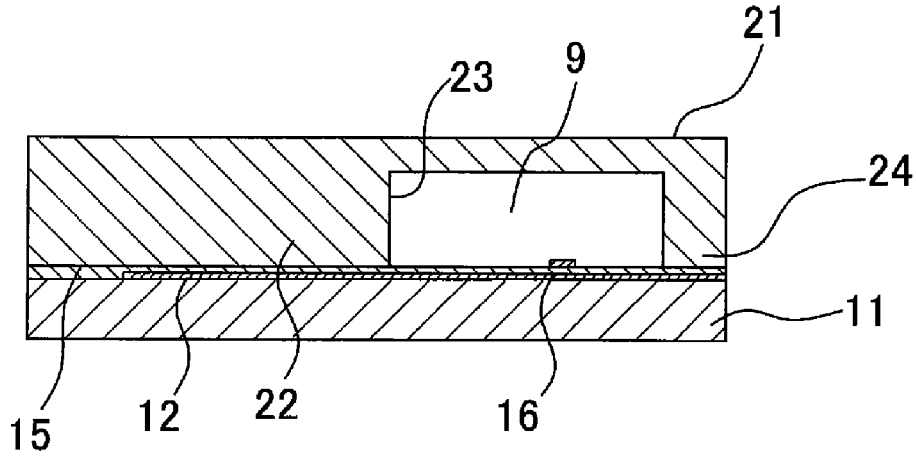

FIG. 2 is an exploded perspective view in which a part of the ink transporting head 1 is enlarged. FIG. 3 is a plan view of FIG. 2. FIG. 4A is a cross-sectional view taken along a IVA-IVA line in FIG. 3 and FIG. 4B is a cross-sectional view taken along a IVB-IVB line in FIG. 3. As shown in FIGS. 1 to 4, in the ink transporting head 1, a lower member 2 which forms a substantial lower half of the ink transporting head 1, and an upper member 3 which forms a substantial upper half of the ink transporting head 1 are joined. In the ink transporting head 1, a common ink channel 9 (common liquid chamber) extending in a left and right direction is arranged, and the plurality of individual ink channels 10 extending frontward upon branching from the common ink channel 9 are arranged at the equal intervals in the left and right direction. In other words, the individual ink channels 10 are mutually arranged at intervals.

The common ink channel 9 is provided at an upstream side (rear side) of the individual ink channels 10, and communicates with all the individual ink channels 10. Moreover, an ink supply port 25 is formed in the common ink channel 9, in an upper surface near a right end portion thereof, and the ink supply port 25 is connected to the tube 4. Moreover, the ink is supplied from the ink tank 5 via the tube 4 and the ink supply port 25 to the common ink channel 9, and further, the ink is supplied from the common ink channel 9 to the individual ink channels 10. Here, the ink tank 5 is arranged at a position somewhat higher than a position of the common ink channel 9, and, a flow directed all the time toward the discharge port 10*a* is generated in the ink inside the common ink channel 9 by an action of a back pressure from the ink tank 5. In this manner, since the individual ink channels 10 and the common ink channel 9 communicating with the individual ink channels 10 is provided to the ink transporting head 1, it is possible to supply easily the ink to the individual ink channels 10 by supplying the ink from the ink tank 5 to the common ink channel 9.

Here, since the individual ink channels 10 and the common ink channel 9 are arranged in the same plane, a structure of ink channels from the common ink channel 9 reaching up to the individual ink channels 10 becomes simple.

Next, each of the lower member 2 and the upper member 3 which form the ink transporting head 1 will be described below.

The lower member 2 is formed by arranging, on an upper surface of a substrate 11, a plurality of individual electrodes 12, a plurality of wire portions 13, an insulating layer 15, a common electrode 16, and a driver IC 14. The substrate 11 is a plate member having a substantially rectangular flat shape, made of an insulating material such as silicon or polyimide, and an entire surface thereof is an insulating surface which is non-electroconductive. The individual electrodes 12 have a substantially rectangular flat shape, and are arranged at the same interval in the left and right direction at a front end portion of an area (an area which is a defining area defining the individual ink channels 10, first area) which is a bottom surface of the individual electrodes 10 on the upper surface of the substrate 11.

The wire portions 13 upon being drawn toward a right side from a corner portion on a right rear side of each individual electrode 12, are extended up to a portion between the adjacent individual ink channels 10, and then the wire portions 13 are bent at a substantially right angle toward a rear side. The wire portion 13, upon passing through an area (second area) positioned between the individual ink channels 10 on the upper surface of the substrate 11 and another area (area which is a defining surface defining the common liquid chamber, third area) which is a bottom surface of the common ink channel 9, are extended up to an area near a rear end portion of the substrate 11, and further upon being bent vertically toward the right side, a front end thereof is connected to the driver IC 14. Further, one of a predetermined driving electric potential $V_1$ and a ground electric potential is selectively applied from the driver IC 14 to the individual electrode 12 via the wiring portion 13.

Here, since all of the individual electrode 12, the wiring portion 13, and the driver IC 14 are provided on the upper surface of the substrate 11, it is possible to connect these easily. Moreover, since the wire portions 13 are arranged between the individual ink channels 10, an unnecessary electrostatic capacitance is not generated between the wire portion 13 and the ink inside the individual ink channel 10.

The individual electrodes 12 and the wire portions 13 are made of an electroconductive material such as a metal, and it is possible to form the individual electrodes 12 and the wire portions 13 by a method such as a screen printing, a sputtering method, and a vapor deposition method. Furthermore, since both the individual electrodes 12 and the wire portions 13 are formed on the upper surface of the substrate 11 (on the same plane), it is possible to form the individual electrodes 12 and the wire portions 13 at the same time.

The insulating layer 15 is made of an insulating material (non-electroconductive material such as a fluororesin). The insulating layer 15 is extended in the left and right direction at a front-end portion of the upper surface of the substrate 11, and covers the individual electrodes 12. The insulating layer 15 is extended up to near a rear-end portion from the front-end portion of the upper surface of the substrate 11, in an area between the adjacent individual ink channels 10 in the left and right direction, and covers a second area and a third area, the second area being an area of the wire portion 13 passing between the adjacent individual ink channels 10, and the third area being an area passing through the common ink channel 9. In this manner, since the wire portion 13 is covered by the insulating layer 15, the wire portion 13 is prevented from making a contact with the ink inside the individual ink channel 10 and the common ink channel 9. Consequently, it is possible to arrange the wire portion 13 such that the wire portion 13 passes through the common ink channel 9, and it is not necessary to draw around the wire portion 13 avoiding the common ink channel 9. In other words, a degree of freedom of arranging the wire portion 13 becomes high.

Here, the insulating layer 15 is formed by forming an insulating material on entire area on the upper surface of the substrate by a spin coating method, and by removing an unnecessary portion by laser. It is also possible to form the insulating layer 15 by a chemical vapor deposition (CVD) method by masking a portion except a portion of forming the insulating layer 15 on the upper surface of the substrate 11. It is also possible to form the insulating layer by applying an insulating material on the upper surface of the substrate 11.

The common electrode 16 is extended in the left and right direction, in an area (third area) which is the bottom surface of the common ink channel 9, at somewhat rear side of a substantially central portion in a front and rear direction of the upper surface of the substrate 11 on which the insulating layer 15 is formed. A length of the common electrode 16 in the front and rear direction in a portion of intersection of the wire portion 13 and the insulating layer 15 (portion of intersection with the wire portion 13 via the insulating layer 15) has become short locally, and in the rest of the portion, the common electrode 16 is extended with a constant width larger than the width of these portions. Accordingly, an area of the portion of intersection of the wire portion 13 and the common electrode 16 via the insulating layer 15 becomes small, and it is possible to make as small as possible an electrostatic capacitance of a portion of the insulating layer 15 sandwiched between the wire portion 13 and the common electrode 16. Moreover, the common electrode 16 is connected to the driver IC 14 at a right-end portion thereof. Furthermore, the common electrode 16 is kept at the ground electric potential (constant electric potential) all the time by the driver IC 14. Accordingly, the ink inside the common ink channel 9 and inside the individual ink channels 10 communicating with the common ink channel 9 is kept at the ground electric potential all the time. The common electrode 16 is made of an electroconductive material similar to an electroconductive material of the individual electrode 16 and the wire portion 13, and it is possible to form the common electrode by a method such as the screen printing, the sputtering method, and the vapor deposition method.

The driver IC 14 is arranged at a right side rear-end portion of the upper surface of the substrate 11, and is connected to the wire portion 13 and the common electrode 16 as described above. Here, since the driver IC 14 is arranged on the upper surface of the substrate 11, it is possible to connect directly the wire portion 13 and the common electrode 16 to the driver IC 14. Accordingly, a separate wiring member such as an FPC is not necessary for connecting the wire portion 13 and the driver IC 14, and it is possible to make simple the structure of the ink transporting head 1.

The upper member 3 has a substrate 21 in which a plurality of partition walls 22, a groove 23, a partition wall 24, and the ink supply port 25 are formed. The substrate 21 is a plate member made of an insulating (non-electroconductive) material such as polyimide, polyamide, polyacetal, and polyphenylene sulfide, having a substantial rectangular flat shape, and a length somewhat shorter than the substrate 11, in the left and right direction. Since the substrate 21 is not connected to an electrode, it is not restricted to have an insulating property, but it is desirable that it has the insulating property.

The partition walls 22 are projected downward from a portion on a lower surface of the substrate 21, overlapping between the adjacent individual ink channels 10 in a plan view, and are extended in the front and rear direction from a front-end portion of the substrate 21 up to a substantial center in the in the front and rear direction. Moreover, since the lower member 2 and the upper member 3 are joined, each of a plurality of spaces surrounded by the upper surface of the substrate 11, the lower surface of the substrate 12 (21), and the partition walls 22, becomes the individual ink channel 10, and the adjacent individual ink channel 10 is isolated by the partition wall 22. At this time, since partition walls 22 are joined to the portion of the substrate 11, overlapping between the adjacent individual ink channels 10, and partition walls 22 cover the wire portion 13 which is covered by the insulating layer 15, it is possible to prevent assuredly the ink inside the individual ink channel 10 from making a contact with the wire portion 13.

The groove 23 is extended across substantially entire length of the substrate 21 in the left and right direction, on a portion on the lower surface of the substrate 21, between a rear-end portion of the partition wall 22 and a rear-end portion of the substrate 21, in the front and rear direction. The partition wall 24 is projected downward from the rear-end portion of the lower surface of the substrate 21, up to a position same as a lower end of the partition wall 22, and is extended across substantially entire length of the substrate 21 in the left and right direction. Moreover, when the lower member 2 and the upper member 3 are joined, a space surrounded by the upper surface of the substrate 11, the groove 23, and the partition wall 24 becomes the common ink channel 9.

The ink supply port 25 is a through hole having a substantially circular shape in a plan view, which is extended downward from the upper surface of the substrate 21, and communicates with the groove 23. Moreover, when the substrate 11 and the substrate 21 are joined, the ink supply port 25 is positioned at an upper side of the right-end portion of the common ink chamber 9, and the driver IC 14 is positioned near the ink supply port 25.

Next, an operation of the ink transporting head 1 will be described below with reference to FIG. 5. FIG. 5 is a diagram showing the operation of the ink transporting head 1.

In the ink transporting head 1, when an electric potential difference is generated between the individual electrode 12 and the ink inside the individual ink channel 10, a wetting angle (liquid repellent property) of the ink on a portion of the insulating layer 15, facing (opposite to) the individual electrode 12 changes depending on the electric potential difference (electrowetting phenomenon). More elaborately, a wetting angle $\theta_v$ of the insulating layer 15 is represented as the following equation, $$\cos\theta_v = \cos\theta_0 + \tfrac{1}{2}\times[(\epsilon\times\epsilon_0)/(\gamma\times t)]V^2$$

where $\theta_v$ means a wetting angle of the insulating layer 15 when the electric potential difference between the individual electrode 12 and the ink inside the individual ink channel 10 is V, $\theta_0$ means the wetting angle of the insulating layer 15 when there is no electric potential difference generated between the individual electrode 12 and the ink inside the individual ink channel 10, $\epsilon$ means a relative dielectric constant of the insulating layer 15, $\epsilon_0$ means a dielectric constant of vacuum, $\gamma$ means a surface tension of a gas-liquid interface, and t means a thickness of the insulating layer. Consequently, with an increase in the electric potential V between the individual electrode 12 and the ink inside the individual ink channel 10, a value of $\cos\theta_0$ increases. In other words, $\theta_v$ becomes small, and the liquid repellent property of the surface of the insulating layer 15 is declined.

Figure 5A:
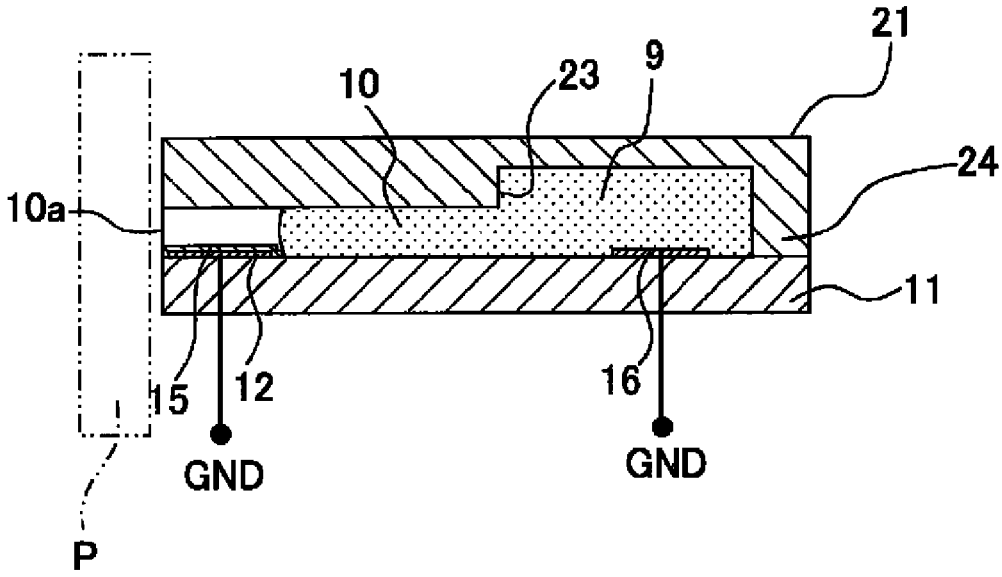
FIGS. 5A and 5B are cross-sectional views showing an operation of the ink transporting head in FIG. 1.

Moreover, in the ink transporting head 1, when the ink is not discharged from the discharge port 10*a*, as shown in FIG. 5A, the ground electric potential is applied to the individual electrode 12, and there is no electric potential difference generated between the individual electrode 12 and the ink inside the individual ink channel 10 which is kept at the ground electric potential. At this time, the wetting angle of the ink on the surface of the insulating layer is greater (higher) than the wetting angle of the ink on the upper surface of the substrate 11, and is greater than the wetting angle (critical wetting angle) of the insulating layer 15 when the ink begin to move from a portion of the individual ink channel 10 where the substrate 11 is exposed, to a portion where the insulating layer 15 is formed. Consequently, a meniscus of the ink inside the individual ink channel 10 is stopped between the insulating layer 15 and the substrate 11, and the ink does not flow to a portion of the individual ink channel 10, facing the insulating layer 15, and the ink is not discharged from the discharge port 10*a*. The critical wetting angle depends on a surface tension of the ink, a difference in the wetting angle of the substrate 11 and the insulating layer 15 with respect to the ink, a channel structure of the common ink channel 9 and the individual ink channel 10, and a magnitude of a back pressure of the ink flowing from the ink tank 5 to the common ink channel 9.

Figure 5B:
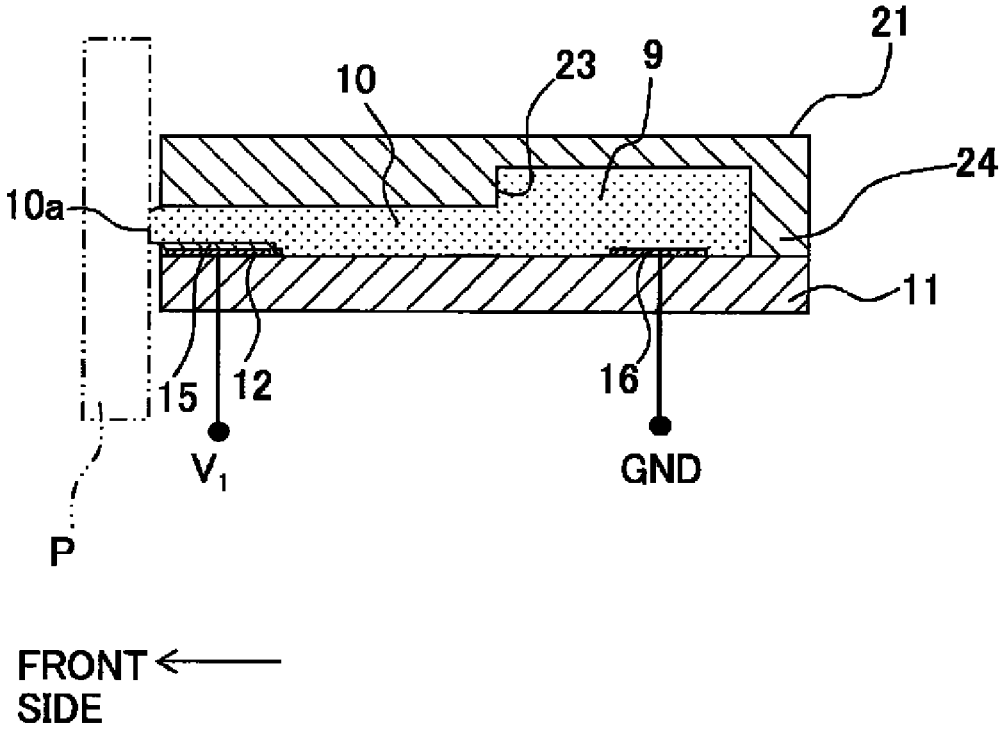

On the other hand, at the time of discharging the ink from the discharge port 10*a*, as shown in FIG. 5B, a driving electric potential $V_1$ is applied to the individual electrode 12. Accordingly, the electric potential difference is generated between the individual electrode 12 and the ink inside the individual ink channel 10, and as it has been described above, the wetting angle of the ink on the surface of the insulating layer 15 is decreased, and becomes smaller than the critical wetting angle. Consequently, the ink flows to the portion of the individual ink channel 10, facing the insulating layer 15, and the ink is discharged from the discharge port 10*a* to the recording paper P. At this time, since the ink inside the individual ink channel 10 is kept at the ground electric potential all the time by the common electrode 16, a fluctuation in the potential difference between the ink inside the individual ink channel 10 and the individual electrode 10 hardly occurs, and a stable operation is possible.

When the driver IC 14 is driven by applying the driving electric potential to the individual electrode 12 in such manner, the driver IC 14 releases heat, and this heat is transmitted to the ink inside the individual ink channel 10 and the common ink channel 9. Here, if the driver IC 14 is positioned near the individual ink channel 10, since a distance between the driver IC 14 and each individual ink channel 10 differs, a fluctuation in a viscosity of the ink inside the individual ink channel 10 should occur. For example, a fluctuation in the viscosity of the ink inside the individual ink channel 10 positioned near the driver IC 14 becomes substantial, and a fluctuation in the viscosity of the ink inside the individual ink channel 10 positioned far away from the driver IC 14 becomes small. Accordingly, there is a variation in the viscosity of the inks in the individual ink channels 10, and as a result of this, there is a variation in discharge characteristics of the inks in the individual ink channels 10.

However, since the heat generated in the driver IC 14 diffuses into the ink inside the common ink channel 9 to the ink inside each individual ink channel 10, the variation in the viscosity of the inks in the individual ink channels 10 ceases to exist. Consequently, it is possible to prevent the occurrence of variation in the discharge characteristics of the ink in the individual ink channels 10.

Furthermore, due to the driver IC 14 being positioned near the ink supply port 25, since the driver IC 14 is positioned at an upstream portion of the common ink channel 9, the heat generated in the driver IC 14 diffuses assuredly through the ink inside the common ink channel 9 to the ink inside each individual ink channel 10. Consequently, there is no variation in a temperature of the ink in the individual ink channels 10, and it is possible to prevent assuredly the occurrence of variation in the discharge characteristics of the ink in the individual ink channels 10.

Moreover, since the wire portion 13 and the common electrode 16 are in a thermal contact with the driver IC 14, the heat generated from the driver IC 14 can also diffuse into the ink via the wire portion 13 and the common electrode 16. Therefore, it is possible to suppress the driver IC 14 from being heated excessively, and to operate the driver IC 14 stably. Here, the wire portion 13 is covered by the insulating layer 15. However, it is possible to form the insulating layer 15 to be thin. Due to this, it is possible to release the heat assuredly generated in the driver IC 14 from the wire portion 13 via the insulating layer 15. Furthermore, it is possible to arrange the common electrode 16 in an uncovered state to the ink. In other words, since it is possible to arrange the common electrode 16 by bringing in a direct contact with the ink, it is possible to release efficiently the heat generated in the driver IC 14 from the common electrode 16.

According to the embodiment described above, since the driver IC 14 is arranged on the upper surface of the substrate 11, it possible to connect directly the wire portion 13 and the driver IC 14 on the upper surface of the substrate 11. Accordingly, a separate wiring member such as an FPC for connecting the wire portion 13 and the driver IC 14 is not necessary, and it is possible to make simple a structure of electrical connections in the ink transporting head 1, and to reduce the manufacturing cost. In addition, since a separate wiring member such as an FPC is not used, a reliability of electrical connection increases.

Furthermore, since all the individual electrodes 12, the wire portion 13, and the driver IC 14 are arranged on the upper surface (on the same plane) of the substrate 11, it is possible to connect easily the individual electrodes 12, the wire portion 13, and the driver IC 14.

Moreover, since the wire portion 13 passes between the adjacent individual ink channels 10, unnecessary electrostatic capacitance is not generated between the ink inside the individual ink channel 10 and the wire portion 13.

Moreover, since the wire portion 13 is covered by the partition wall as well as by the insulating layer 15, it is possible to prevent the wire portion 13 from making a contact with the ink.

Moreover, since the individual ink channel 10 and the common ink channel 9 are arranged on the upper surface (on the same plane) of the substrate 11, the structure of the ink channels becomes simple.

Moreover, since the driver IC 14 is arranged near the common ink channel 9, the heat generated in the driver IC 14 transmits to the ink inside the common ink channel 9, and diffuses through the ink inside the common ink channel 9 to the ink inside each individual ink channel 10. Therefore, there hardly occurs variation in the viscosity of the ink in the individual ink channels 10, and the occurrence of variation in the discharge characteristics in the ink in the individual ink channels 10 is suppressed. At this time, further, since the driver IC 14 is arranged near the ink supply port 25, and is positioned at the upstream portion of the common ink channel 9, the heat generated in the driver IC 14 diffuses assuredly through the ink in the common ink channel 9 to the ink in each individual ink channel 10. Consequently, the occurrence of variation in the discharge characteristics of the ink in the individual ink channels 10 is prevented assuredly.

Moreover, it is possible to arrange the wire portion 13 inside the common ink channel 9 by covering the wire portion 13 by the insulating layer 15 in the common ink channel 9. Accordingly, a degree of freedom of arrangement of the wire portion 13 becomes high.

Moreover, in the common ink channel 9, the wire portion 13 is covered by the insulating layer 15, and the common electrode 16 is formed thereon, it is possible to provide the wire portion 13 and the common electrode 16 at an overlapping position on the upper surface of the substrate 11. Accordingly, it is not necessary to draw around the wire portion 13 avoiding the common electrode 16, and the degree of freedom of arrangement of the wire portion becomes high.

Moreover, since the wire portion 13 is in contact with the ink via the insulating layer 15, it is possible to release the heat generated in the driver IC 14 to the ink via the wire portion 13 and the insulating layer 15. In other words, the wire portion 13 is formed to be thermally conductive with the driver IC 14 and the ink. Furthermore, since the common electrode 16 makes a direct contact with the ink, it is possible to release the heat generated in the driver IC 14 to the ink, through the common electrode 16 assuredly. Therefore, the driver IC 14 is prevented from being unstable due to being excessively heated. Even in such case, since the heat is transmitted to the ink at a multiple number of locations through the common electrode 16 and the wire section 13 which are arranged in dispersed manner, the ink is not overheated locally. Moreover, when the common electrode 16 is only making a contact electrically with the ink, it may not necessarily make a direct contact with the ink, but by arranging to make a direct contact with the ink, it is possible to achieve such heat releasing effect.

Next, modified embodiments in which various modifications are made in the embodiment will be described below. The same reference numerals are assigned to components having the same structure as in the embodiment, and the description of such components is appropriately omitted.

Figure 6:
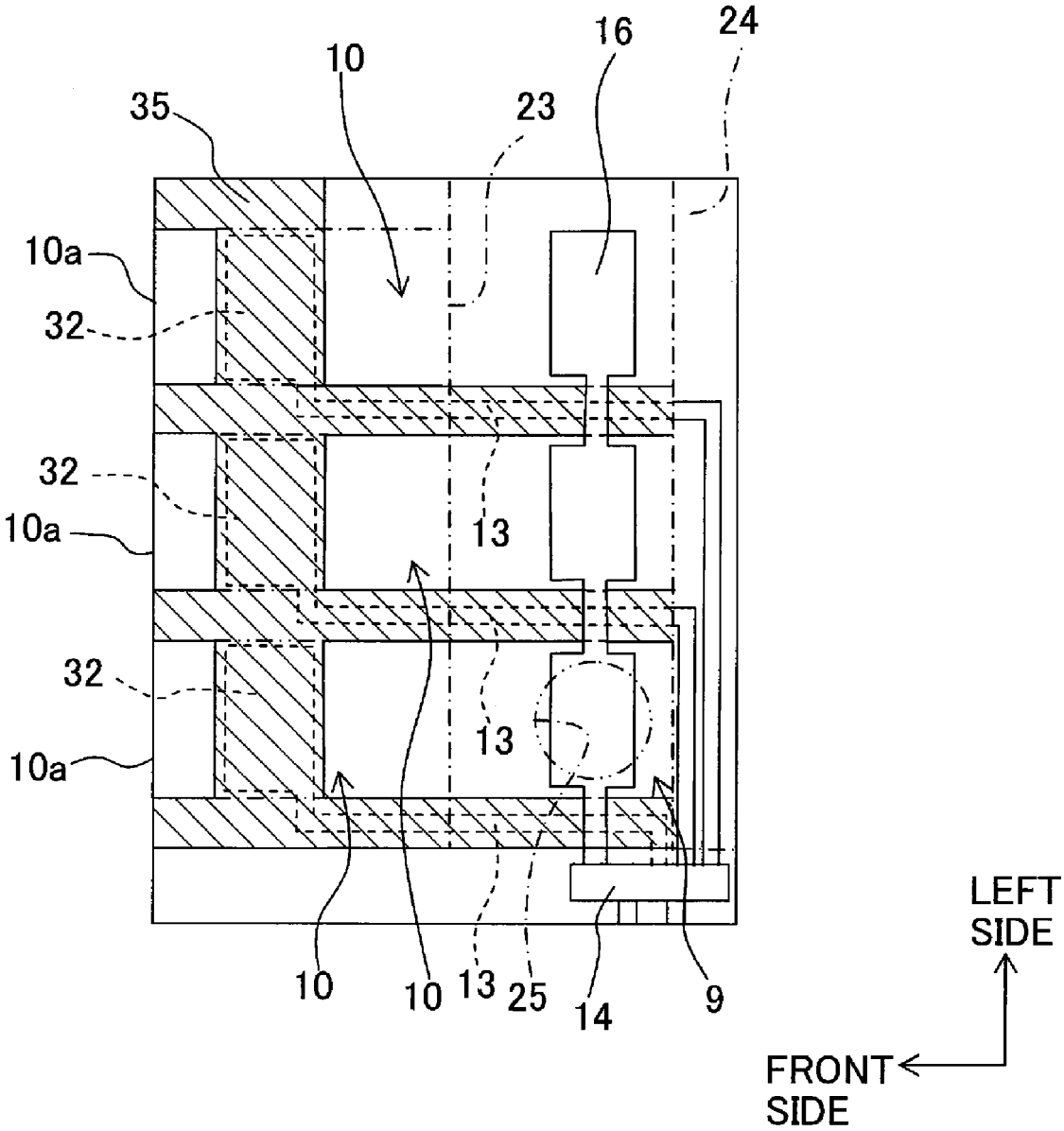
FIG. 6 is a plan view corresponding to FIG. 3, of a first modified embodiment.

In a first modified embodiment, as shown in FIG. 6, an individual electrode 32 is arranged on a portion of the bottom surface of the individual ink channel 10, at somewhat rear side of the front-end portion, and an insulating layer 35 is extended in the left and right direction to cover the individual electrode 32, and also extended in the front and rear direction in an area (second area) between the adjacent individual ink channels 10, but not formed in an area of the individual ink channel 10, which defines a portion at a front side of the individual electrode 12.

Figure 7A:
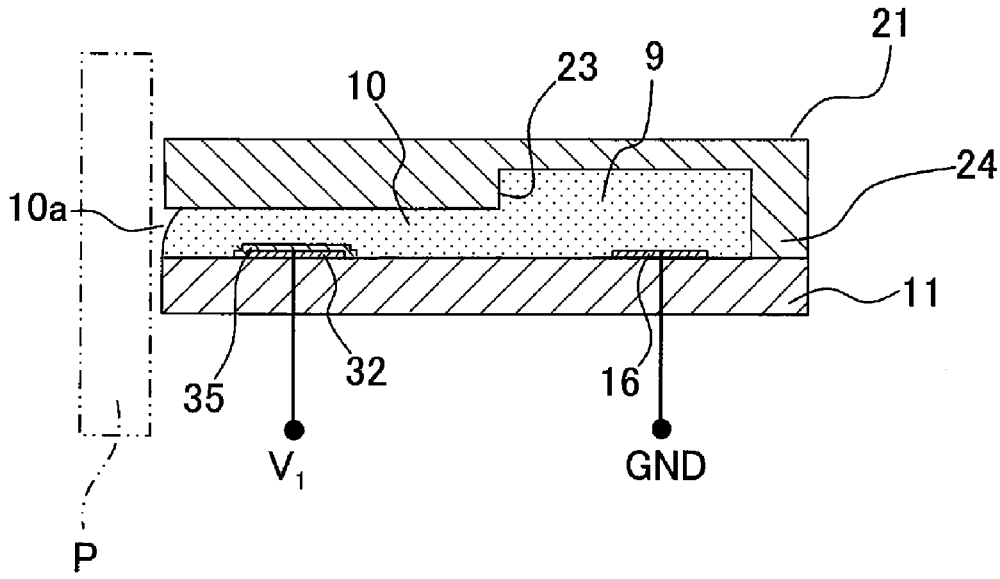
FIGS. 7A and 7B are plan views corresponding to FIGS. 5A and 5B of the first modified embodiment.

In this case, as shown in FIG. 7A, when the ink is not discharged from the discharge port 10*a*, driving electric potential $V_1$ is applied to the individual electrode 32, and since the wetting angle of the ink in a portion on the surface of the insulating layer 35, facing the individual electrode 32 is small, the ink is positioned at an entire area of the common ink channel 9 and the individual ink channels 10. At this time, the ink is prevented from flowing from the discharge port 10*a* due to the surface tension of the ink.

Figure 7B:
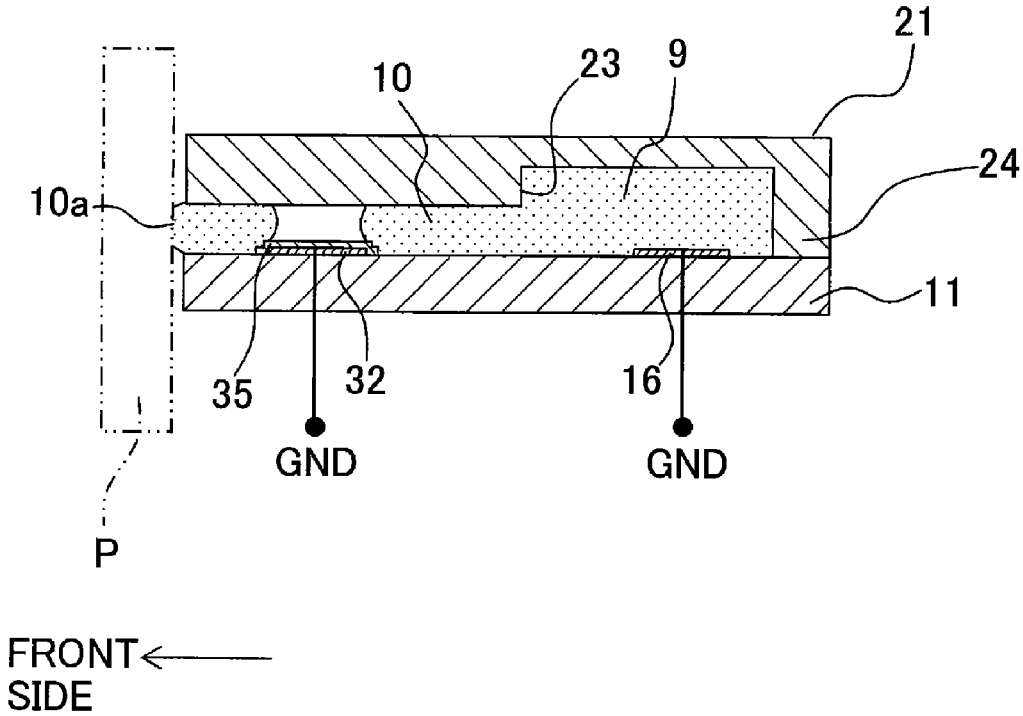

Moreover, at the time of discharging the ink from the discharge port 10*a*, as shown in FIG. 7B, the ground electric potential is applied to the individual electrode 32 corresponding to the discharge port 10*a* discharging the ink. As the ground electric potential is applied, the wetting angle of the ink in the portion on the surface of the insulating layer 35, facing the individual electrode 32 is increased, and the ink inside the individual ink channel 10 moves to an area in which the insulating layer 35 is not formed, having the wetting angle of the ink on the surface smaller than this area, in other words, moves frontward and rearward (moves to the front side and the rear side) of the individual ink channel 10. Furthermore, due to the ink moved to the front side of the individual ink channel 10, the ink at the front side (frontward) of the portion of the individual ink channel 10, facing the insulating layer 35 is pushed, and is discharged on to the recording paper P from the discharge port 10*a*.

In the first modified embodiment, a back pressure lower than the surface tension of the ink in the discharge port 10*a* when the ink is not discharged from the discharge port 10*a* may let to act on the ink. However, it is preferable that the ink tank 5 (refer to FIG. 1) is positioned at almost same height as the common ink channel 9, and there is no back pressure acting on the ink inside the individual ink channel 10.

Figure 8:
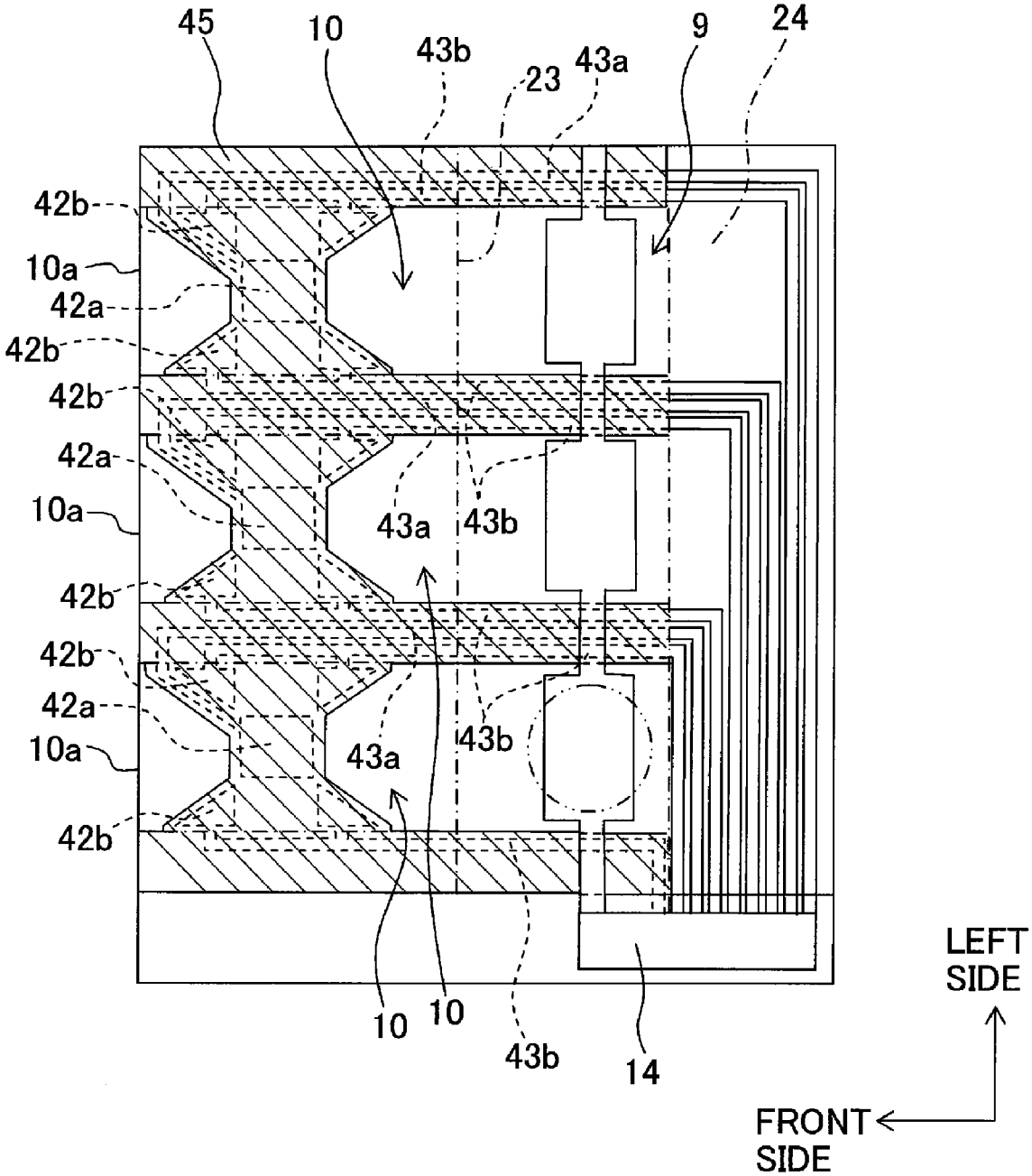
FIG. 8 is a plan view corresponding to FIG. 3, of a second modified embodiment.

In a second modified embodiment, as shown in FIG. 8, an individual electrode 42*a* having a substantial rectangular flat shape is formed on the bottom surface (first area) of each individual ink channel 10, in a substantially central portion in the left and right direction on a somewhat rearward direction of the front-end portion, and an individual electrode 42*b* having a substantial right angled triangular flat shape is formed on an outer side of four corners of the individual electrode 42*a*. The individual electrode 42*a* and the individual electrode 42*b* are connected to the driver IC 14 via a wire portion 43*a* and a wire portion 43*b* respectively, and one of the ground electric potential and the driving electric potential $V_1$ is selectively applied.

Figure 9A:
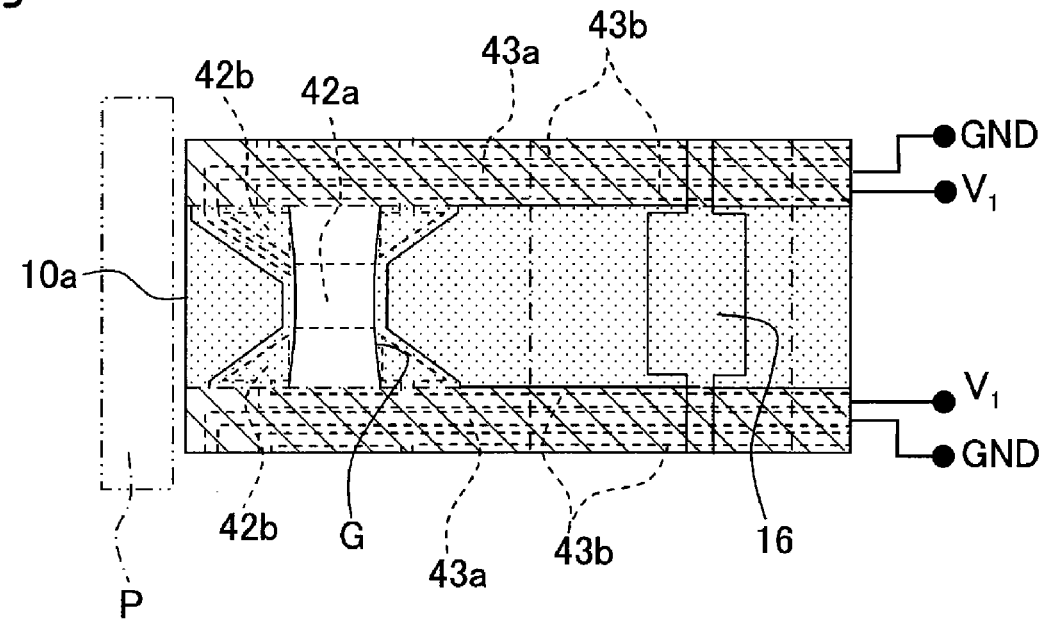
FIGS. 9A and 9B are plan views showing an operation of an ink transporting head in the second modified embodiment.

In this case, when the ink is not discharged, as shown in FIG. 9A, the ground electric potential is applied to the individual electrode 42*a* and the driving electric potential $V_1$ is applied to the individual electrode 42*b* by the driver IC 14. Accordingly, the wetting angle of the ink in a portion of an insulating layer 45, facing the individual electrode 42*b* becomes smaller than the critical wetting angle, and the wetting angle of the ink in the other portion (the rest of the portion) of the insulating layer 45 becomes greater than the critical wetting angle. Consequently, out of the portion of the individual ink channel 10, facing the insulating layer 45, the ink exists only on a portion facing the individual electrode 42*b*, and out of the portion of the individual ink channel 10, facing the insulating layer 45, an air bubble G exists in an area extended in the left and right direction, including the portion facing the individual electrode 42*a*. Further, due to the air bubble G, the ink inside the individual ink channel 10 is held back from flowing to the discharge port 10*a*.

Figure 9B:
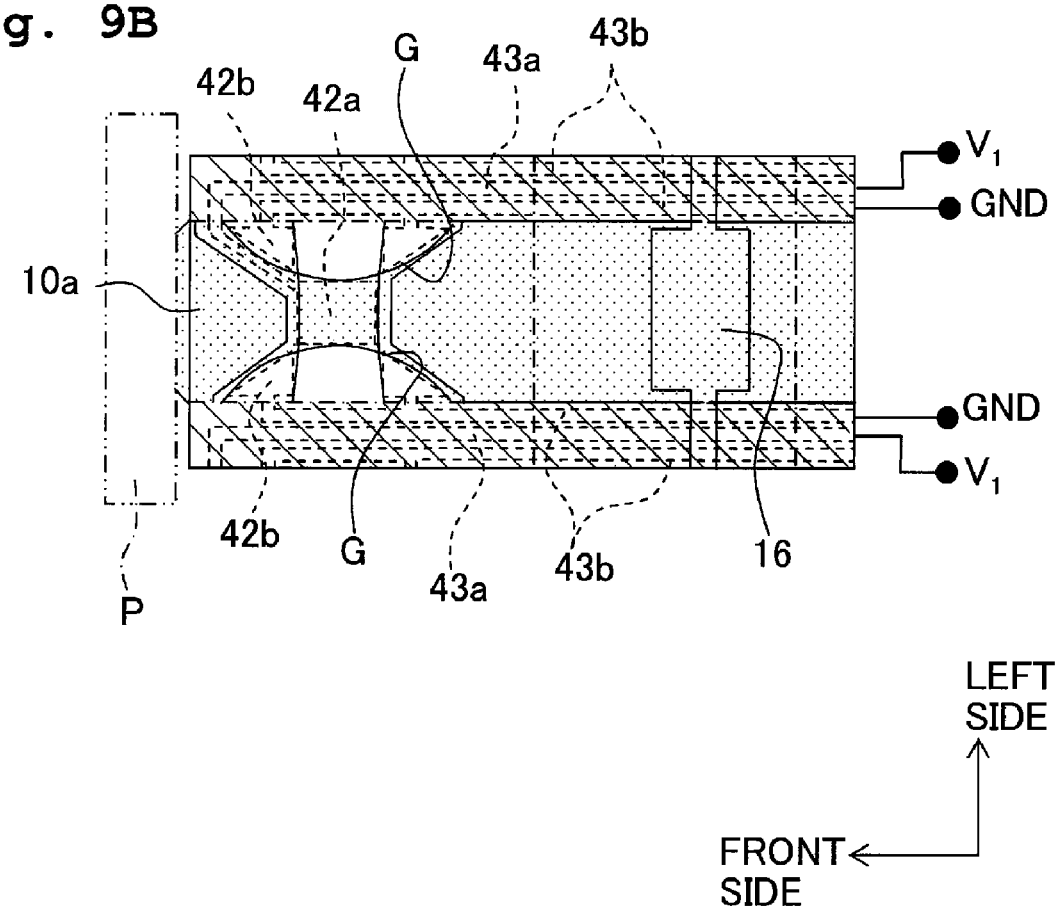

At the time of discharging the ink from the discharge port 10*a*, as shown in FIG. 9B, the driving electric potential $V_1$ is applied to the individual electrode 42*a*, and the ground electric potential is applied to the individual electrode 42*b*. As the driving electric potential $V_1$ and the ground electric potential are applied, the wetting angle of the ink in the portion of the insulating layer 45, facing the individual electrode 42*b* becomes greater than the critical wetting angle, and the wetting angle of the ink in the portion of the insulating layer 45, facing the individual electrode 42*a* becomes smaller than the critical wetting angle, and the ink moves to be positioned only at the portion facing the individual electrode 42*a*, in a portion of the individual ink channel 10, overlapping with the insulating layer 45. With this, the air bubble G inside the individual ink channel 10 also moves, and the bubble is positioned in two areas at both sides of the individual electrode 42*a* in the left and right direction, and extended in the front and rear direction including the portion facing the individual electrode 42*b* in the portion of the individual ink channel 10, facing the insulating layer 15. Accordingly, the ink inside the individual ink channel 10 is not held back by the air bubble G, and the ink is discharged from the discharge port 10*a* on to the recording paper P.

Figure 10:
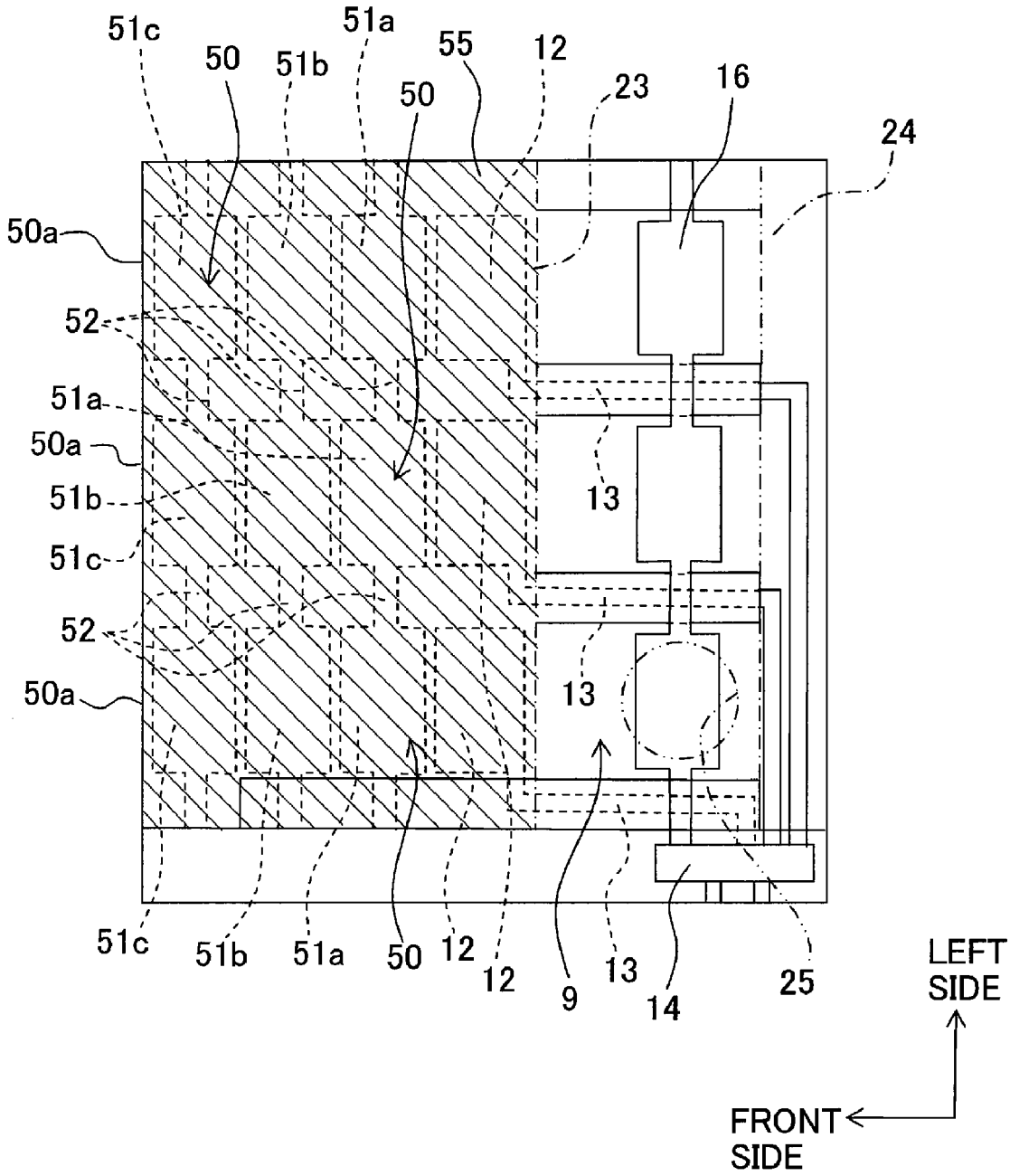
FIG. 10 is a plan view corresponding to FIG. 3, of a third modified embodiment.

In a third modified embodiment, as shown in FIG. 10, three electrodes each 51*a*, 51*b*, and 51*c* which are arranged at an equal interval in the front and rear direction, are formed at a front side of each individual electrode 12. Each of the three sets of electrodes 51*a*, 51*b*, and 51*c* arranged in the left and right direction are connected mutually by wire portions 52. An insulating layer 55 is formed continuously in an area extended in the front and rear direction between adjacent ink channels 50 in the left and right direction, and another area overlapping with the individual electrodes 12 and the electrodes 51*a*, 51*b*, and 51*c*. The electrodes 51*a*, 51*b*, and 51*c* are connected to the driver IC 14 via wires at positions not shown in the diagram, and one of the driving electric potential $V_1$ and the ground electric potential is applied to the electrodes 51*a*, 51*b*, and 51*c*.

Figure 11A:
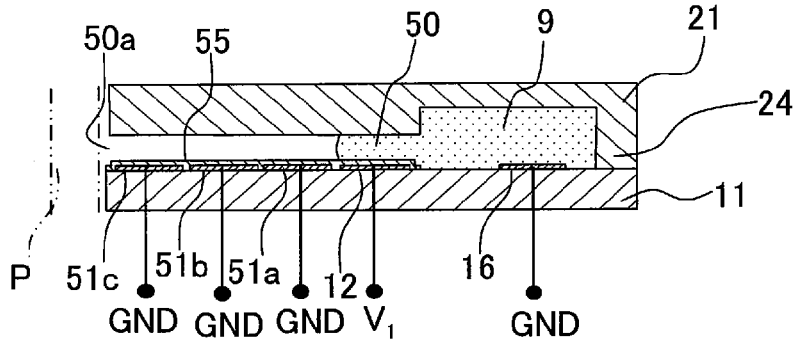
FIGS. 11A, 11B, 11C and 11D are cross-sectional views corresponding to FIGS. 5A and 5B of the third modified embodiment.

In this case, when the ink is not discharged from a discharge port 50*a*, the ground electric potential is applied to the individual electrode 12 and the electrodes 51*a*, 51*b*, and 51*c*, and the ink does not flow to a portion facing the insulating layer 55, similarly as in the first embodiment. Moreover, at the time of discharging the ink, similarly as in the embodiment, as shown in FIG. 11A, when the driving electric potential V1 is applied to the individual electrode 12, the ink inside the common ink channel 9 flows to a portion of the insulating layer 55, facing the individual electrode 12.

Figure 11B:
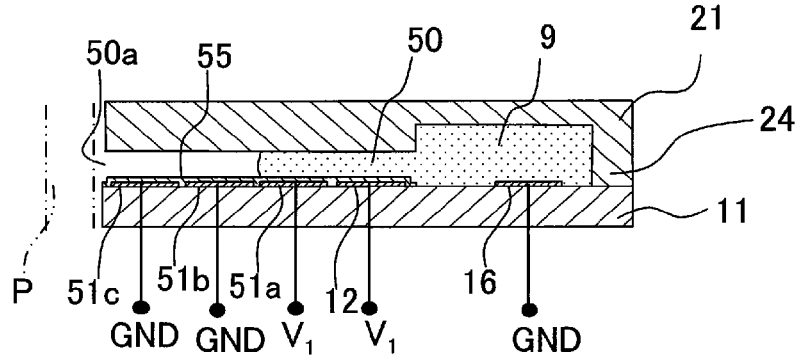
Figure 11C:
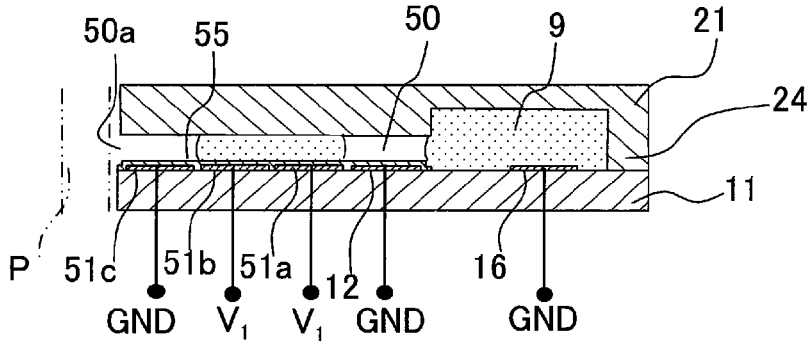

Next, as shown in FIG. 11B, when the driving electric potential $V_1$ is applied to the electrode 51*a*, the ink further flows up to a portion facing the electrode 51*a*. Moreover, at a point of time where the ink has flowed to the electrode 51*a*, as shown in FIG. 11C, when the electric potential of the individual electrode 12 is returned (set again) to the ground electric potential, the ink positioned at the portion facing the individual electrode 12 moves in the front and rear direction, and the ink positioned at the electrode 51*a* is separated from the ink inside the common ink channel 9.

Figure 11D:
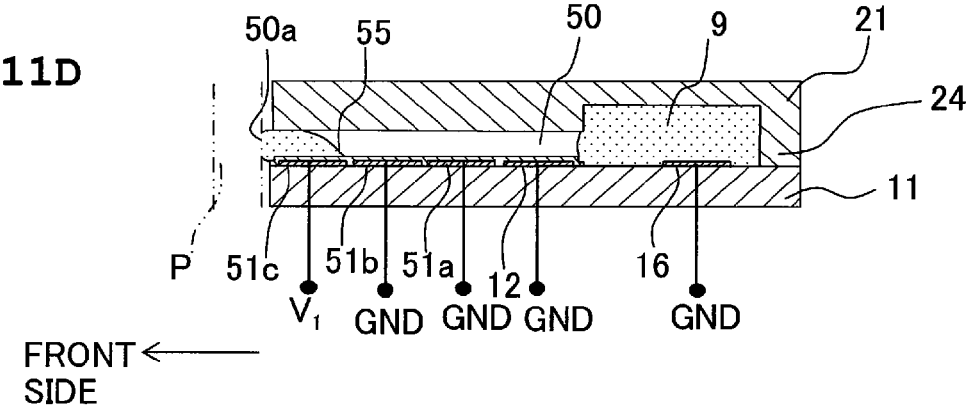

Thereafter, the driving electric potential $V_1$ is applied to the electrode 51*b*, and at a point of time where the ink has flowed to a portion facing the electrode 51*b*, the electric potential of the electrode 51*a* is returned (set again) to the ground electric potential. Further, thereafter, the driving electric potential $V_1$ is applied to the electrode 51*c*, and at a point of time where the ink has flowed to a portion facing the electrode 51*c*, the electric potential of the electrode 51*b* is returned to the ground electric potential. Accordingly, the ink gradually moves to the portions facing the electrodes 51*b* and 51*c*, and finally, as shown in FIG. 11D, the ink is discharged from the discharge port 50*a* to the recording paper P. In the third embodiment, each of the electrodes 51*a*, the electrodes 51*b*, and the electrodes 51*c*, which are adjacent in the left and right direction are connected by the wires 52. However, the electrodes 51*a*, 51*b*, and 51*c* may be connected mutually, and may be connected separately to the driver IC 14.

Figure 12:
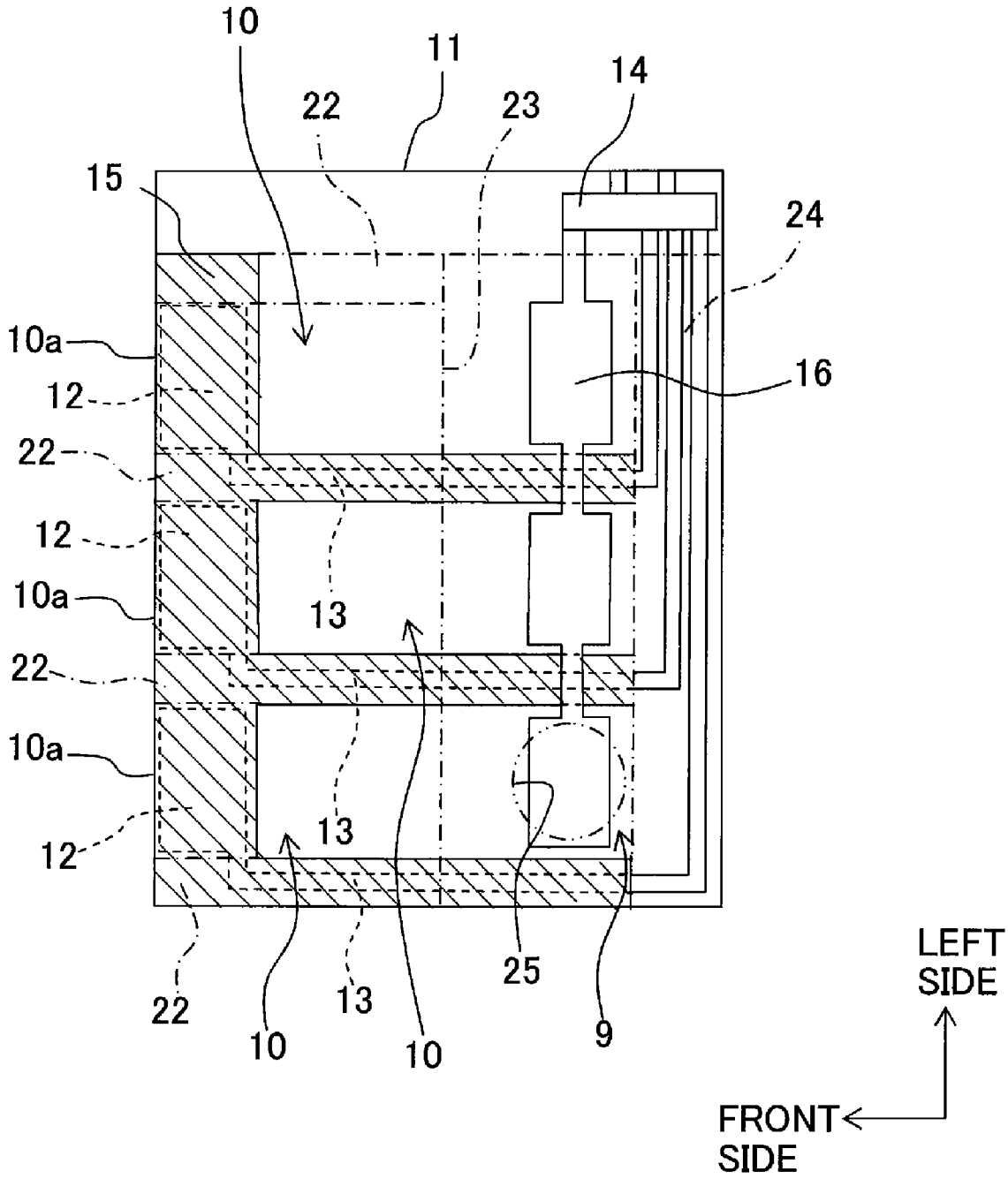
FIG. 12 is a plan view corresponding to FIG. 3, of a fourth modified embodiment.

A position at which the driver IC 14 is arranged is not restricted to the position in the embodiments described above. In a fourth modified embodiment, as shown in FIG. 12, the driver IC 14 is arranged at a left rear-end portion on the upper surface of the substrate 11. In this case, the driver IC 14 is close to the common ink channel 9, but is arranged away from the ink supply port 25. Even in this case, since the driver IC 14 is arranged near the common ink channel 9, the heat generated in the driver IC 14 after being transmitted to the ink inside the common ink channel 9, diffuses through the ink inside the common ink channel 9 to the ink inside each individual ink channel 10. Accordingly, a variation in temperature of the ink hardly occurs among the individual ink channels 10, and it is possible to prevent the occurrence of variation in the discharge characteristics of ink among the individual ink channels 10.

Figure 13:
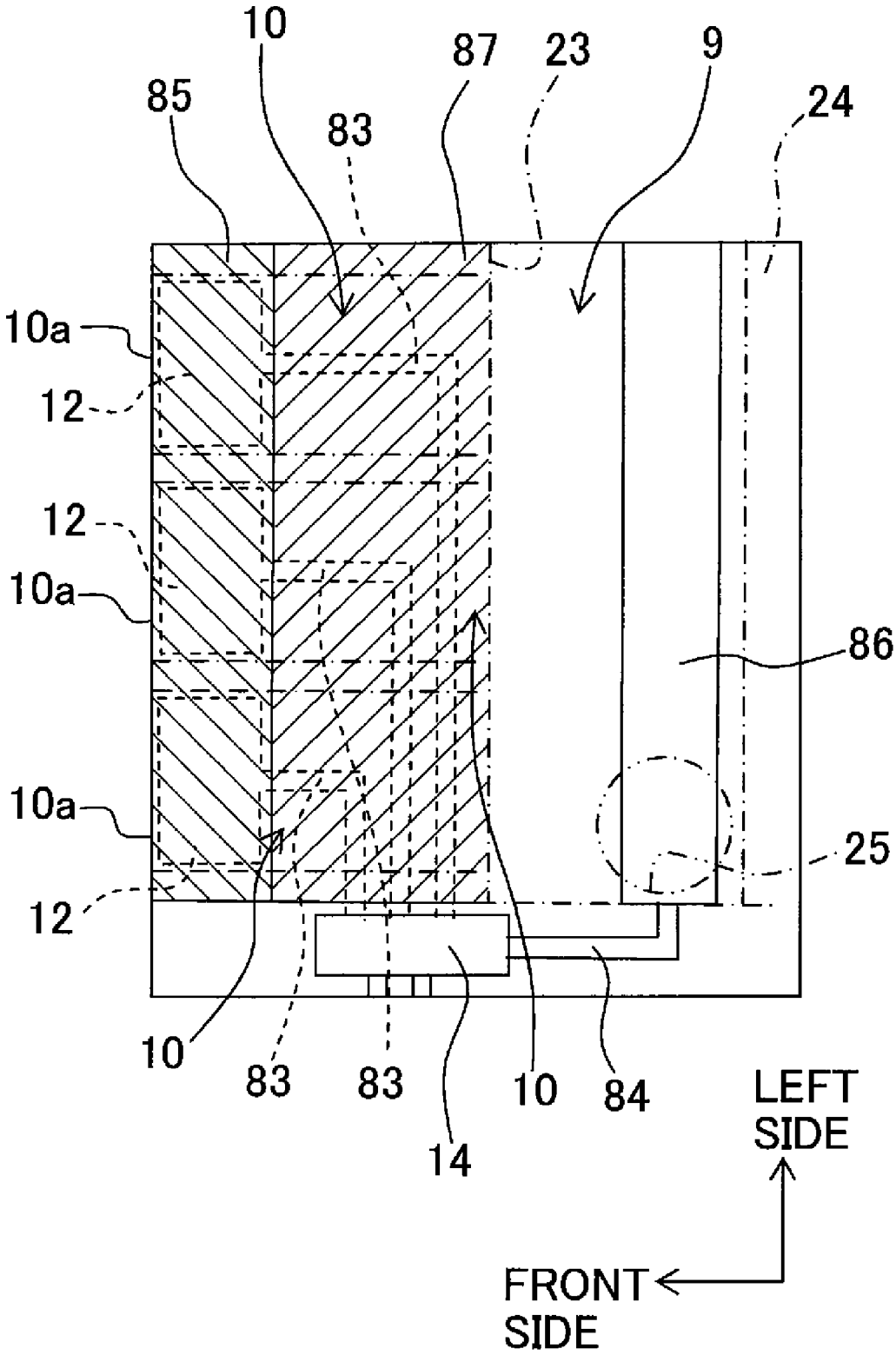
FIG. 13 is a plan view corresponding to FIG. 3, of a fifth modified embodiment.

In a fifth modified embodiment, as shown in FIG. 13, the driver IC 14 is arranged in a portion at a right end portion of the substrate 11, on somewhat rear side of the individual electrode 12. Moreover, a wire portion 83 is drawn from a central portion at a rear side of the individual electrode, and is extended rearward of a bottom surface (second area) of the individual ink channel 10 of the substrate 11. Further, on the way, the wire portion 83 is bent vertically toward a right side inside the individual ink channel 10, and is extended up to the driver IC 14. Moreover, on the upper surface of the substrate 11, an insulating layer 85 covering the individual electrodes 12 is formed, and also, an insulating layer 87 covering a portion of the plurality of wire portions 83, positioned in the individual ink channel 10, is formed in an area spread over the individual electrodes 10. Moreover, a common electrode 86 is extended with a constant width, and is extended toward a right side from the common electrode 86. On the way, the common electrode 86 is bent vertically downward and is connected to the driver IC 14 by a wire portion 84 which is extended up to the driver IC 14.

In this case, since the wire portions 83 are inside the individual ink channel 10, and are not arranged to be extended in the front and rear direction between the adjacent individual ink channels 10, it is possible to make highly integrated by narrowing an interval between the individual ink channels 10. Moreover, since the wire portion 83 and the common electrode 86 do not intersect, as in the embodiment described above, it is not necessary to make a width of the common electrode 86 narrow locally for reducing the electrostatic capacitance in the insulating layer 85, and a formation of the common electrode 86 becomes easy.

Figure 14:
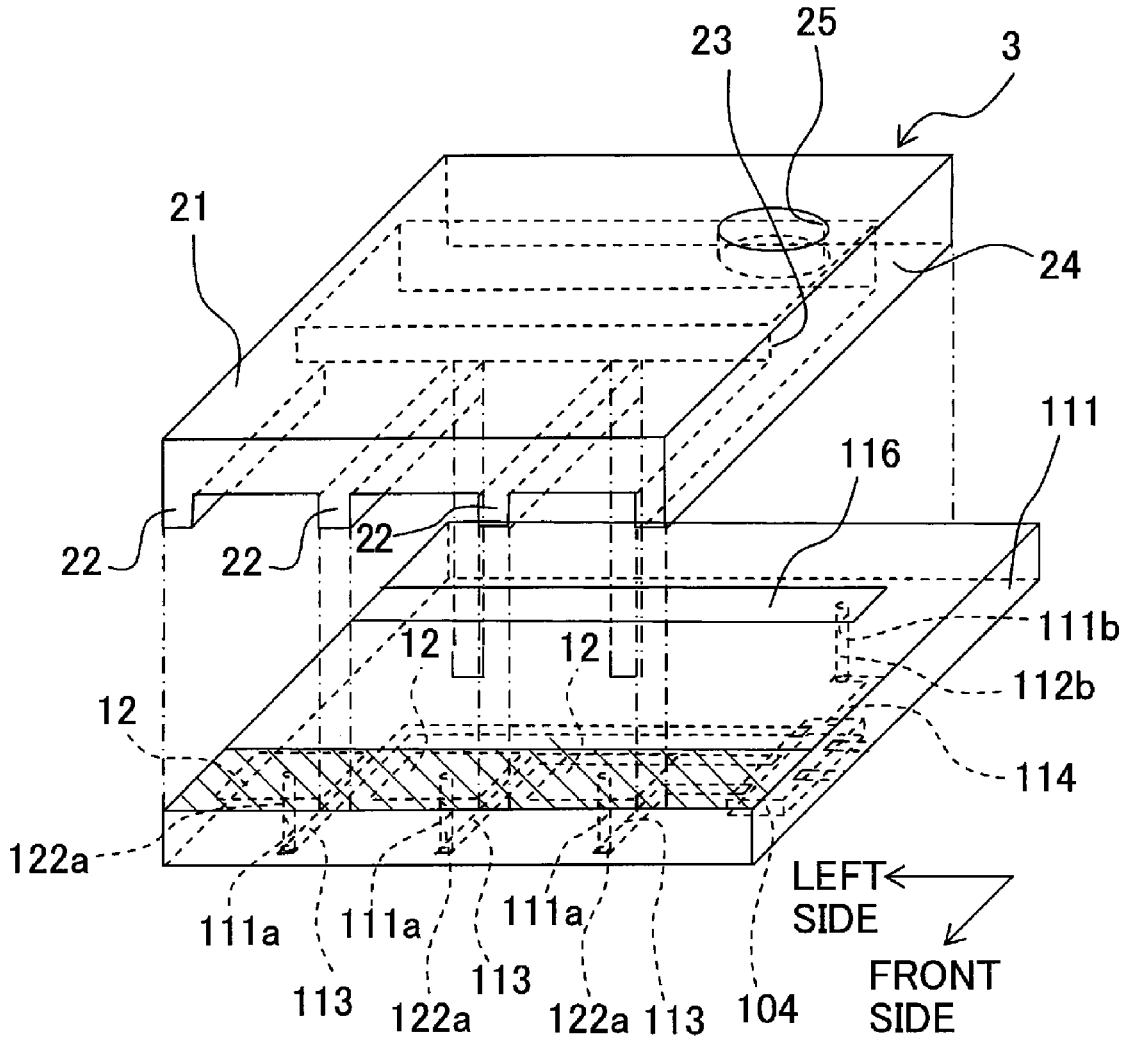
FIG. 14 is a plan view corresponding to FIG. 3, of a sixth modified embodiment.

In a sixth modified embodiment, as shown in FIG. 14, the plurality of individual electrodes 12 similar as in the embodiment are formed on a front-end portion of a substrate 111, and also, a common electrode 116 which is extended with a constant width in the left and right direction near a rear-end portion is formed. Moreover, in the substrate 111, a through hole 111*a* which is extended downward from a position on an upper surface, facing a substantially central portion of each individual electrode 12, and a through hole 111*b* which is extended downward from a right-end portion of the common electrode 116 on the upper surface are formed, and filling members 122*a* and 122*b* made of an electroconductive material such as a metal are filled in the through holes 111*a* and 111*b* respectively. A driver IC 104 is arranged at a right front-end portion on a lower surface of the substrate 111. Moreover, a wire portion 113*a* which is extended rearward from a lower end of each through hole 111*a*, then bent vertically to right on the way, and is further extended up to the driver IC 104, and a wire portion 113*b* which is extended to right side from a lower end of the through hole 111*b*, then bent vertically downward on the way, and is further extended up to the driver IC 104 are formed on the lower surface of the substrate 111.

Even in this case, since the driver IC 104 is arranged on the lower surface of the substrate 111, it is possible to connect the individual electrode 12 and the driver IC 104 via the filling member 122*a* and the wire portion 113*a*, and to connect the individual electrode 12 and the driver IC 104 via the filling member 122*b* and the wire portion 114. Accordingly, since a separate wiring member such as an FPC is not necessary, it is possible to make simple the structure of the ink transporting head, and to reduce the manufacturing cost thereof.

The driver IC 14 (and the driver IC 104) are not restricted to be arranged on the upper surface and the lower surface of the substrates 11 and 111, and the driver IC 14, 104 may be arranged on a side surface of the substrates 11 and 111. In other words, the driver IC 14, 104 are not to be provided necessarily on the same plane on which the individual electrode and the wire portion are provided. Moreover, as long as the wire portion connects the driver IC and the individual electrode, the wire portion may not necessarily pass through the second area which is positioned between the liquid transporting channels.

In the embodiment and the modified embodiments described above, the substrate 11 is formed by an insulating (non-electroconductive) material. However, the substrate 11 may be structured by forming a insulating film on a surface of a substrate made of a metallic material, and at least a portion of the surface of the substrate on which the individual electrode 12, the wire portion 13, the common electrode 16, and the driver IC 14 area arranged, may be an insulating surface.

Moreover, in the description made above, an example in which, the present invention is applied to an ink transporting head which discharges an ink on to a recording paper P has been described. However, the present invention is also applicable to a liquid transporting apparatus which transports a liquid other than ink such as a reagent, a biomedical solution, a wiring material solution, an electronic material solution, for a cooling medium (refrigerant), and for a liquid fuel.

What is claimed is:

1. A liquid transporting apparatus which transports an electroconductive liquid, comprising:

a substrate having an insulating surface;

a plurality of liquid transporting channels which transport individually the electroconductive liquid and which are arranged at intervals on a plurality of first areas of the insulating surface, respectively, the first areas defining the liquid transporting channels;

a common liquid chamber which communicates with the liquid transporting channels, and which supplies the electroconductive liquid to the liquid transporting channels;

a plurality of individual electrodes arranged on the first areas of the insulating surface respectively;

an insulating layer which covers the individual electrodes, and in which a liquid repellent property of a surface thereof changes depending on an electric potential difference between the electroconductive liquid and the individual electrode;

a plurality of wire portions which are arranged on the insulating surface, and which are connected to the individual electrodes respectively; and a driver IC which is arranged on the insulating surface and which is connected to the wire portions, and which applies a driving electric potential to the individual electrodes via the wire portions;

wherein the wire portions make a thermoconductive contact with the driver IC and the electroconductive liquid.

2. The liquid transporting apparatus according to claim 1, wherein the individual electrodes, the wire portions, and the driver IC are provided on a same plane.

3. The liquid transporting apparatus according to claim 1, wherein the substrate is made of silicon or polyimide, and the insulating layer is made of a fluororesin.

4. A printer in which the electroconductive liquid is an ink, comprising:

a liquid transporting apparatus according to claim 1;

an ink tank which stores the ink; and a tube which connects the liquid transporting apparatus and the ink tank.

5. The liquid transporting apparatus according to claim 2, wherein the wire portions are extended up to the driver IC upon passing through a second area which is positioned between the liquid transporting channels on the insulating surface.

6. The liquid transporting apparatus according to claim 2, wherein the wire portions are extended up to the driver IC upon passing through the first area, and a portion of the wire portions passing through the first area is covered by the insulating layer.

7. The liquid transporting apparatus according to claim 2, wherein the liquid transporting channels and the common liquid chamber are provided on the same plane.

8. The liquid transporting apparatus according to claim 5, wherein the liquid transporting channels are isolated by partition walls arranged between the liquid transporting channels, and a portion of the wire portions positioned on the second area is covered by the partition walls.

9. The liquid transporting apparatus according to claim 5, wherein a portion of the wire portions positioned on the second area is covered by the insulating layer.

10. The liquid transporting apparatus according to claim 7, wherein the driver IC is arranged near the common liquid chamber.

11. The liquid transporting apparatus according to claim 7, wherein the insulating surface has a third area defining the common liquid chamber, the wire portions pass through the third area of the insulating surface, and a portion of the wire portions passing through the third area is covered by the insulating layer.

12. The liquid transporting apparatus according to claim 10, wherein a liquid supply port which supplies the electroconductive liquid is formed in the common liquid chamber, and the driver IC is arranged near the liquid supply port.

13. The liquid transporting apparatus according to claim 11, wherein a common electrode which is kept at a constant electric potential is arranged in the third area, and the wire portions intersect with the common electrode via the insulating layer in the third area.

14. The liquid transporting apparatus according to claim 13, wherein the common electrode makes a thermoconductive contact with the driver IC and the electroconductive liquid.

15. The liquid transporting apparatus according to claim 14, wherein the common electrode makes a direct contact with the electroconductive liquid.

* * * * *